US011350807B2

(12) United States Patent
Schaller et al.

(10) Patent No.: US 11,350,807 B2
(45) Date of Patent: Jun. 7, 2022

(54) LOW NOISE STICK VACUUM CLEANER

(71) Applicant: Aktiebolaget Electrolux, Stockholm (SE)

(72) Inventors: Maeva Schaller, Stockholm (SE); Christian Ågren, Stockholm (SE); Håkan Miefalk, Stockholm (SE); Tommy Andersson, Stockholm (SE)

(73) Assignee: Aktiebolaget Electrolux

( * ) Notice: Subject to any disclaimer, the term of this patent is extended or adjusted under 35 U.S.C. 154(b) by 403 days.

(21) Appl. No.: 16/336,170

(22) PCT Filed: Oct. 7, 2016

(86) PCT No.: PCT/EP2016/074054
§ 371 (c)(1),
(2) Date: Mar. 25, 2019

(87) PCT Pub. No.: WO2018/065069
PCT Pub. Date: Apr. 12, 2018

(65) Prior Publication Data
US 2020/0154964 A1 May 21, 2020

(51) Int. Cl.
*A47L 9/00* (2006.01)
*A47L 5/24* (2006.01)
*A47L 9/32* (2006.01)

(52) U.S. Cl.
CPC ..... *A47L 9/0081* (2013.01); *A47L 5/24* (2013.01); *A47L 9/322* (2013.01)

(58) Field of Classification Search
CPC ..... A47L 9/0081; A47L 5/24; A47L 9/322
See application file for complete search history.

(56) References Cited

U.S. PATENT DOCUMENTS

| | | | | |
|---|---|---|---|---|
| 2,342,905 | A * | 2/1944 | Smellie | A47L 9/1454 96/382 |
| 4,967,443 | A | 11/1990 | Krasznai et al. | |
| 6,158,082 | A * | 12/2000 | Beckey | A47L 9/0081 15/326 |
| 9,439,548 | B2 * | 9/2016 | Jenson | A47L 9/322 |
| 2002/0092123 | A1 | 7/2002 | Stephens et al. | |
| 2007/0136984 | A1 * | 6/2007 | Hsu | A47L 9/2884 15/339 |
| 2008/0040883 | A1 | 2/2008 | Beskow et al. | |

(Continued)

FOREIGN PATENT DOCUMENTS

| | | | |
|---|---|---|---|
| CN | 203314885 | U | 12/2013 |
| CN | 203314887 | U | 12/2013 |

(Continued)

OTHER PUBLICATIONS

Chinese Office Action for Chinese Application No. 201680089728.3, dated Mar. 31, 2021, 7 pages.

(Continued)

*Primary Examiner* — David Redding
(74) *Attorney, Agent, or Firm* — RatnerPrestia

(57) ABSTRACT

A stick vacuum cleaner having a handheld vacuum cleaner adapted to be docked to a stick. When the handheld vacuum cleaner is docked to the stick an air path is formed connecting an air outlet of the handheld vacuum cleaner with an air outlet provided in the stick. A noise absorption unit is provided in the air path or outside the air outlet from the stick.

1 Claim, 4 Drawing Sheets

(56) References Cited

U.S. PATENT DOCUMENTS

| | | | | |
|---|---|---|---|---|
| 2015/0289733 | A1* | 10/2015 | Rowntree | A47L 5/28 15/329 |
| 2015/0335217 | A1* | 11/2015 | Fritsche | A47L 5/18 134/10 |

FOREIGN PATENT DOCUMENTS

| | | | |
|---|---|---|---|
| EP | 1190660 | A2 | 3/2002 |
| WO | 2004069021 | A1 | 8/2004 |
| WO | 2008088278 | A2 | 7/2008 |

OTHER PUBLICATIONS

Chinese Office Action for Chinese Application No. 201680089728.3, dated Aug. 27, 2020, 7 pages.
International Search Report and Written Opinion for International Application No. PCT/EP2016/074054, dated Jul. 17, 2017, 9 pages.

* cited by examiner

LOW NOISE STICK VACUUM CLEANER

This application is a U.S. National Phase application of PCT International Application No. PCT/EP2016/074054, filed Oct. 7, 2016, which is incorporated by reference herein.

TECHNICAL FIELD

The invention relates to a vacuum cleaner. In particular the invention relates to a stick vacuum cleaner.

BACKGROUND

Hand held vacuum cleaners which are battery powered as well as powered by mains supply, are previously known, see for instance U.S. Pat. No. 4,967,443, and are used for fast cleaning of small surfaces. It is important that such vacuum cleaners are easily accessible and user friendly designed. These vacuum cleaners are usually designed such that the dust container together with the filter can be removed from the remaining part of the vacuum cleaner housing that contains the fan unit.

It is also previously known to use the type of hand held vacuum cleaner described above in combination with a shaft part whose, lower portion supports a nozzle. This type of hand held vacuum cleaner can be referred to as a stick vacuum cleaner or a 2-in-1 stick vacuum cleaner, see for instance WO 2004/069021. The shaft part is provided with a tube connection by means of which dust laden air is transferred from the nozzle to the air inlet of the hand held vacuum cleaner which is removably secured to the shaft part. This means that the combined stick vacuum cleaner in a comfortable way can be used for floor cleaning purpose. In other words, the handheld stick vacuum cleaner can be docked and undocked to/from the stick to allow for floor cleaning when the hand held vacuum cleaner is docked to the stick. Another conventional stick vacuum cleaner is described in WO2008/088278.

In a conventional stick vacuum cleaner there are strict space requirements. This reduces the possibilities to provide components requiring a large space in the stick vacuum cleaner resulting to worse performance in some aspects compared to conventional vacuum cleaners because some conventional components may have to be omitted or replaced with a less efficient component in a handheld vacuum cleaner. There is a constant desire to improve the performance of vacuum cleaners. Hence there is a need for an improved stick vacuum cleaner.

SUMMARY

It is an object of the present invention to provide an improved vacuum cleaner. In particular it is an object of the present invention to provide an improved stick vacuum cleaner.

This object is obtained by the stick vacuum cleaner as set out in the appended claims.

In accordance with one embodiment a stick vacuum cleaner comprising a handheld vacuum cleaner adapted to be docked to a stick is provided. When the handheld vacuum cleaner is docked to the stick an air path is formed connecting an air outlet of the handheld vacuum cleaner with an air outlet provided in the stick. A noise absorption unit is provided in the air path. Hereby the noise is reduced from the vacuum cleaner when configured in a docked mode of operation. The noise absorption unit can as an alternative or as a supplement be provided on the outside of the stick at the air outlet from the stick.

In accordance with one embodiment an air tight sealing is provided at the air inlet in the stick or at the air outlet from the handheld vacuum cleaner or both at the air inlet in the stick and at the air outlet. The air tight sealing can be sound proof. In accordance with one embodiment the sound proof sealing is U-shaped.

In accordance with one embodiment the noise absorption unit comprises a muffler. The muffler can be formed by an inner tube and an outer tube having an absorber material placed therein-between.

In accordance with one embodiment a channel formed by the inner tube is given a cross section of at least 2 cm.

The invention also extends to a stick for use in a vacuum cleaner in accordance with the above.

BRIEF DESCRIPTION OF THE DRAWINGS

The invention will now be described in more detail, by way of example, and with reference to the accompanying drawings, in which.

DETAILED DESCRIPTION

The invention will now be described more fully hereinafter with reference to the accompanying drawings, in which certain embodiments of the invention are shown. The invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
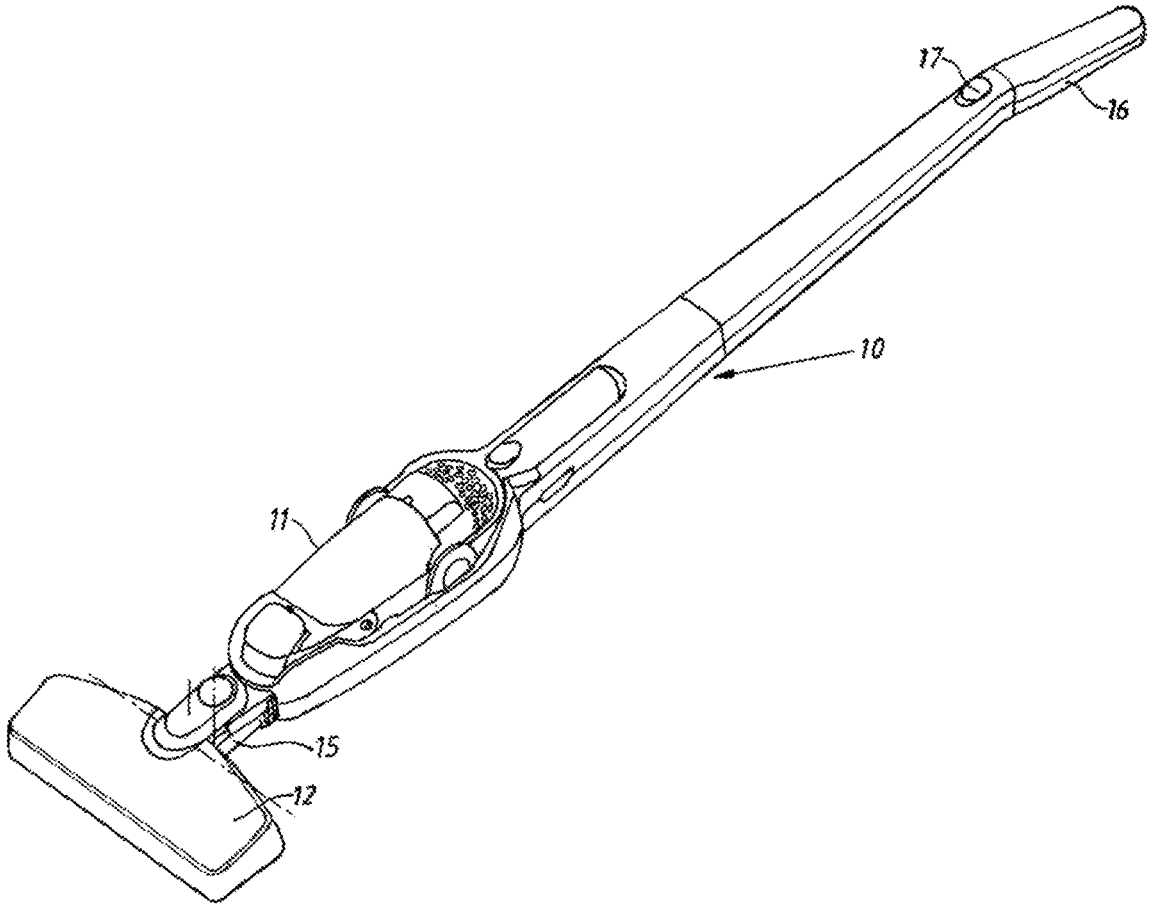
FIG. 1 shows a stick vacuum cleaner according to the prior art.

FIG. 1 schematically shows a conventional stick vacuum cleaner 10 according to the prior art. The shown stick vacuum cleaner 10 comprises an elongated shaft part. The elongated shaft part can be referred to as the stick. In the stick a hand held vacuum cleaner 11 is removably arranged. Thus the hand held vacuum cleaner can thereby be docked and un-docked to/from the stick. The lower end of the stick supports a floor nozzle 12 that can be turnably secured to the stick. The nozzle has an elongated suction opening and the suction opening is via a passage 15 connected to the hand held vacuum cleaner 11 in a conventional manner. The upper portion of the stick can be shaped as a handle 16 and typically has an operating knob 17 that via an electric circuit, not shown in detail, is connected to the hand held vacuum cleaner 11 when it is docked to the stick.

A problem associated with a stick vacuum cleaner such as the one depicted in FIG. 1 is that there are strict space limitations for providing devices inside the handheld vacuum cleaner 11. This is because there are typically strict requirements as to the size and weight of the handheld vacuum cleaner to not make it bulky and difficult to operate. As a result, some elements are typically omitted or made very small in the handheld vacuum cleaner. For example, there is typically no noise absorption unit provided in the handheld vacuum cleaner or such a noise absorption unit is made very small and does not provide efficient noise reduction.

In order to at least partly solve or reduce this problem, a noise absorption unit can be located in the stick in an air passage way from the air outlet of the handheld vacuum cleaner 11 to the air outlet from the stick 13. Hereby it is achieved that an improved noise reduction can be provided when the stick vacuum cleaner is in a docked mode where the handheld vacuum cleaner is docked to the stick. The noise absorption unit can as an alternative or as a supplement be provided on the outside of the stick at the air outlet from the stick.

Figure 2:
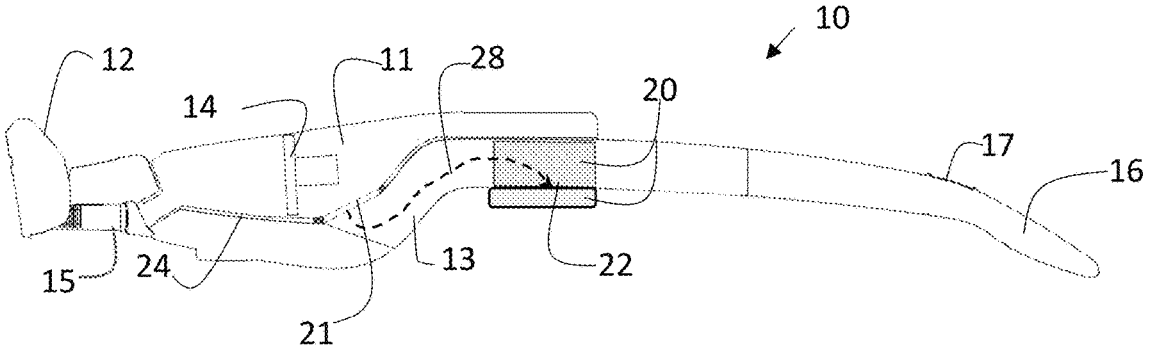
FIGS. 2 and 3 show a sectional view of a stick vacuum cleaner in different embodiments.

In FIG. 2 a sectional view from the side of a stick vacuum cleaner 10 is shown. In FIG. 2 a stick 13 of the stick vacuum cleaner 10 is provided with a noise absorption unit 20. The noise absorption unit 20 can be located in the air path from the handheld vacuum cleaner 11 in the stick 13. In FIG. 2 the air path is illustrated by the arrow 28. Thus, the noise absorption unit 20 can be located in the air path from the air outlet 21 of the handheld vacuum cleaner 11 to an air outlet 22 from the stick 13. When in use, a motor 14 of the handheld vacuum cleaner 11 draw air from the nozzle 12 via the air passage 15 and out from the handheld vacuum cleaner 11 via the air outlet 21. If the handheld vacuum cleaner 11 is docked to the stick 13 (e.g., in receptacle 24) the outlet air continues via the air path 28 to the air outlet 22 in the stick 13.

In order to make the noise reduction efficient an air tight sealing can be provided at the air inlet in the stick or the air outlet 21 from the handheld vacuum cleaner or both.

Further, in FIG. 2 the noise absorption unit is shown as directly connecting the air outlet 21 with the air outlet 22. However, it is also envisaged that an air path is provided inside the stick directing outlet air from the handheld vacuum cleaner to an air outlet provided in the stick. The noise absorption unit 20 can be formed by a container of loosely packed sound absorbing material such as wool.

Figure 3:
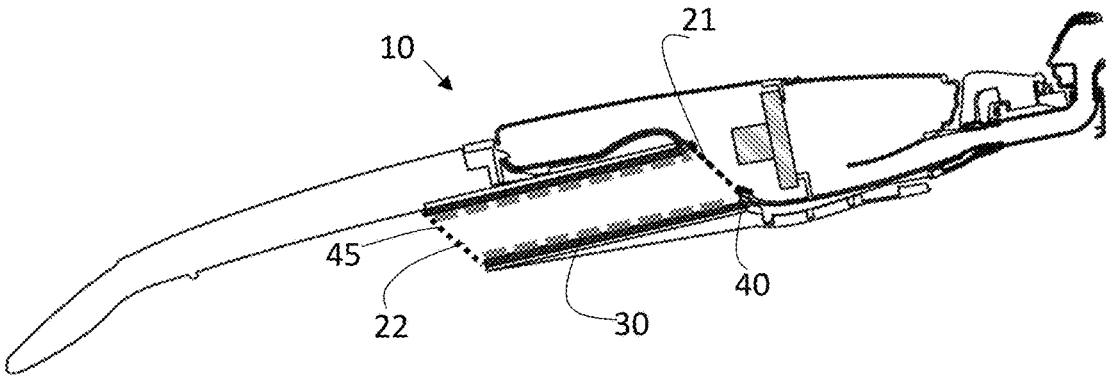

In FIG. 3 a sectional view from the side of a stick vacuum cleaner 10 in accordance with another embodiment is shown. The embodiment in FIG. 3 is similar to the embodiment shown in FIG. 2 and has a noise absorption unit formed as a muffler 30. The muffler 30 can be connected to the air outlet 21 from the hand held vacuum cleaner via a connection having a sound proof sealing 40.

Figure 4:
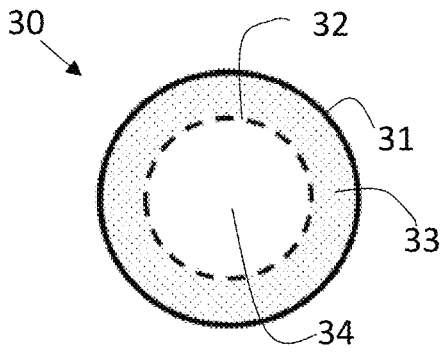
FIG. 4 shows a muffler.

As is shown in FIG. 4, the muffler 30 can be a tube composed of an outer tube 31, an inner perforated tube 32 and in the middle an absorber material 33 can be provided. In accordance with some embodiments, at least one of the tubes 31, 32 and preferably both the outer and inner tubes 31, 32 are formed by a plastics material or some other slightly flexible material. The absorber material 33 can typically be a cushioning material formed by wool, dense cotton fibers, foam, or a similar material. The muffler 30 will form a channel 34 with a cross section where air can pass to be let out from the stick vacuum cleaner. The design of the cross section area of the channel 34 will impact the performance of the air flow from the stick vacuum cleaner 10. For example, a small cross section will give rise to higher losses. It is therefore advantageous to provide a muffler with a channel having a cross section more than 2 cm and preferably more than 3 cm. The air outlet 22 from the stick vacuum cleaner located at the outlet end of the muffler 30 can be provided with a perforated cover and with a diffusor 45.

Figure 5:
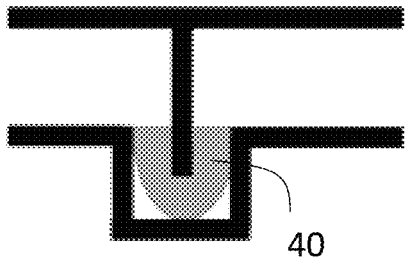
FIG. 5 shows a sound proof sealing.

In FIG. 5, a view of a sound proof sealing 40 is shown. The sound proof sealing can be a U-shaped sealing or in some instances a V-shaped sealing. A sound proof sealing is more demanding than having an air-tight sealing. By providing the sealing in a U shape insulation is improved thereby reducing sound.

Figure 6A:
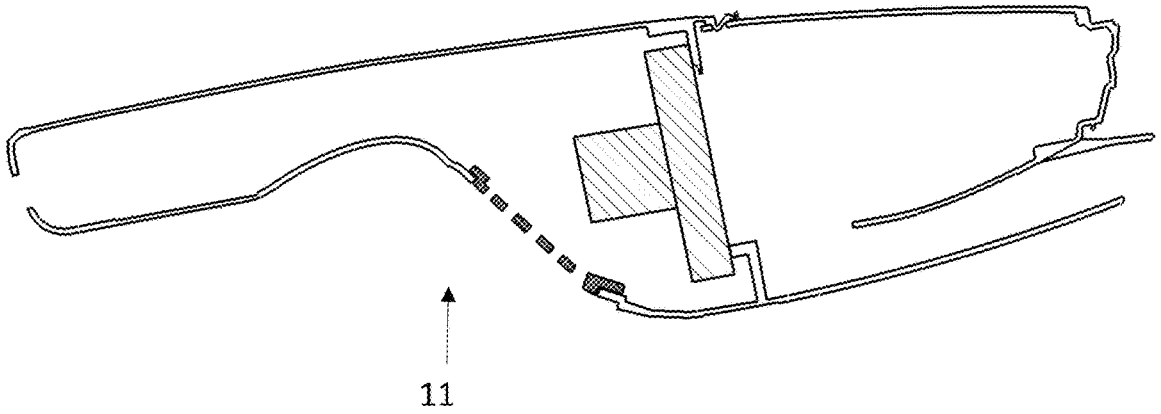
FIGS. 6*a* and 6*b* shows a stick vacuum cleaner in an un-docked configuration.
Figure 6B:
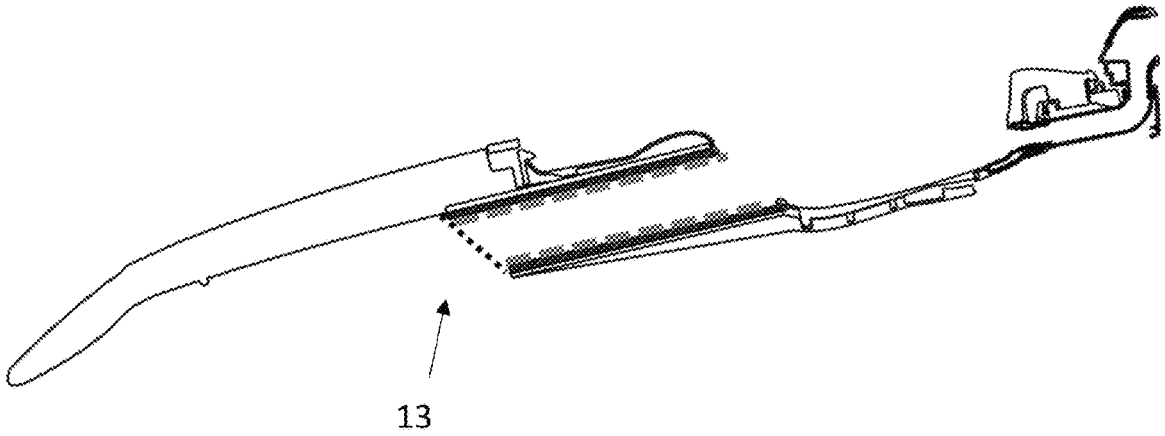

In FIGS. 6*a* and 6*b* the hand held vacuum cleaner 11 and the stick 13 of the stick vacuum cleaner are shown undocked from each other.

The invention has been described above with reference to a few embodiments. However, as is readily appreciated by a person skilled in the art, other embodiments than the ones disclosed above are equally possible within the scope of the invention, as defined by the appended claims.

The invention claimed is:

1. A vacuum cleaner system comprising:

a handheld vacuum cleaner;

a stick configured to attach to the handheld vacuum cleaner to form a stick vacuum cleaner;

wherein the handheld vacuum cleaner and stick form an air path when the stick is attached to the handheld vacuum cleaner, the air path extending to an air outlet provided in the stick;

at least one a noise absorption unit in the air path or covering the air outlet; and an air tight sealing forming part of the air path when the handheld vacuum cleaner is attached to the handheld vacuum cleaner, wherein the air tight sealing is comprises a U-shaped sound proof sealing.

* * * * *